US005278881A

United States Patent [19]

Kato et al.

[11] Patent Number: 5,278,881

[45] Date of Patent: Jan. 11, 1994

[54] FE-CR-MN ALLOY

[75] Inventors: Takahiko Kato, Katsuta; Heishichiro Takahashi, Sapporo; Shinzoo Ikeda, Ibaraki; Jiro Kuniya, Hitachi, all of Japan

[73] Assignee: Hitachi, Ltd., Tokyo, Japan

[21] Appl. No.: 969,520

[22] Filed: Oct. 30, 1992

Related U.S. Application Data

[63] Continuation of Ser. No. 553,554, Jul. 18, 1990, abandoned.

[30] Foreign Application Priority Data

Jul. 20, 1989 [JP] Japan ..... 1-188203

[51] Int. Cl.[5] ..... G21C 11/00

[52] U.S. Cl. ..... 376/305; 376/150; 376/457; 376/900; 420/57; 420/74; 420/79

[58] Field of Search ..... 376/146, 150, 288, 305, 376/457, 900, 906; 420/56, 57, 74, 79

[56] References Cited

U.S. PATENT DOCUMENTS

| | | | |
|---|---|---|---|
| H326 | 9/1987 | Brager et al. | 376/900 |
| 3,148,979 | 9/1964 | Malagari, Jr. | 420/56 |
| 3,362,813 | 1/1968 | Ziolkowski | 420/57 |
| 3,535,095 | 10/1970 | Niwa | 420/56 |
| 3,850,584 | 11/1974 | Bohm et al. | 376/900 |
| 4,398,951 | 8/1983 | Wallwork | 420/79 |
| 4,718,949 | 1/1988 | Takase et al. | 376/457 |
| 4,810,461 | 3/1989 | Inagaki et al. | 376/457 |
| 4,875,933 | 10/1989 | Wan | 420/74 |
| 4,966,636 | 10/1990 | Wan | 420/74 |

FOREIGN PATENT DOCUMENTS

| | | |
|---|---|---|
| 9560 | 1/1986 | Japan . |
| 238353 | 10/1987 | Japan . |

*Primary Examiner*—Daniel D. Wasil

*Attorney, Agent, or Firm*—Antonelli, Terry, Stout & Kraus

[57] ABSTRACT

An Fe-Cr-Mn alloy is disclosed which has the following composition by wt% and corrosion resistance of which is improved and deterioration in its strength is prevented at grain boundaries due to irradiation of high-energy particles such as neutrons: 5 to 40% of Mn, 5 to 18% of Cr, 2.0 to 12% of Al and the balance of Fe except for unavoidable impurities. In the alloy according to the present invention, Al is added to an Fe-Cr-Mn alloy by a restricted quantity as a main component element. As a result of the addition of Al, an alloy can be obtained in which lowering of concentration of Cr at grain boundaries due to irradiation of high-energy particles such as neutrons can be prevented or concentration of the solutes can be raised.

16 Claims, 8 Drawing Sheets

ALLOY ACCORDING TO THE PRESENT INVENTION (COMPOSITION CHANGE IN THE VICINITY OF GRAIN BOUNDARY DUE TO IRRADIATION)

ALLOY ACCORDING TO THE PRESENT INVENTION
(COMPOSITION CHANGE IN THE VICINITY OF GRAIN BOUNDARY DUE TO IRRADIATION)

COMPARATIVE ALLOY
(COMPOSITION CHANGE IN THE VICINITY OF GRAIN BOUNDARY DUE TO IRRADIATION)

ALLOY ACCORDING TO THE PRESENT INVENTION
(COMPOSITION CHANGE IN THE VICINITY OF GRAIN BOUNDARY DUE TO IRRADIATION)

COMPARATIVE ALLOY
(COMPOSITION CHANGE IN THE VICINITY OF GRAIN BOUNDARY DUE TO IRRADIATION)

FE-CR-MN ALLOY

This application is a continuation of application Ser. No. 07/553,554, filed Jul. 18, 1990, now abandoned.

BACKGROUND OF THE INVENTION

1. Field of the Invention

The present invention relates to an Fe-Cr-Mn alloy for constituting a reactor for a nuclear fusion reactor, a fast breeder reactor, a light-water nuclear reactor or the like. More particularly, the present invention relates to an Fe-Cr-Mn alloy capable of satisfactorily preventing the lowering of concentration of chromium at grain boundaries when subjected to a neutron irradiation environment.

2. Prior Art

Hitherto, the Fe-Cr-Mn alloy, which has been developed as the material for use as the atomic reactor material, is constituted by substituting nickel with manganese, nickel being a main component of the Fe-Cr-Ni alloy, which had been widely employed as the steel for the light-water nuclear reactor or the fast breeder reactor. Furthermore, element compositional proportion of the alloy has been changed or minor elements have been added to the alloy for the purpose of securing the phase stability. Therefore, an advantage can be obtained in that residual radioactivity (to be called "induced radioactivity" hereinafter) of the radioactive isotope, formed by irradiation of neutrons having the energy spectrum generated due to fusion reaction, can be reduced. Therefore, safety of the nuclear fusion reactor can significantly be improved and an excellent economical advantage can be obtained in terms of facility of the maintenance of the reactor and efficiency of the waste disposal and re-utilization of reactor systems.

In Japanese Patent Unexamined Publication No. 61-9560, a conventional alloy is disclosed, which has fine austenitic structure and which is composed of 20 to 40 wt% of manganese, 0 to 15 wt% of chromium, 0.4 to 3.0 wt% of silicon, at least one of less than 0.7 wt% carbon and 0.3 wt% of nitrogen each of which quantity can stabilize fine austenitic structure, 0 to 0.1 wt% of phosphor, 0 to 0.01 wt% of boron, 0 to 3.0 wt% of aluminum, 0 to 0.5 wt% of nickel, 0 to 2.0 wt% of tungsten, 0 to 1.0 wt% of tantalum, 0 to 2.5 wt% of vanadium and the balance substantially composed of iron. High manganese austenitic steel having a same structure and improved high temperature strength is disclosed in Japanese Patent Unexamined Publication No. 62-238353, the high manganese austenitic steel being composed of, by weight, 0.05 to 0.5% of carbon, 12 to 50% of manganese, 2 to 20% of chromium, 0.1 to 5.0% of silicon, 0.01 to 4.0% of aluminum, 0.25% or less of nitrogen, one or more elements selected from a group consisting of 0.01 to 1.0% of titanium, 0.01 to 1.0% of niobium and 0.005 to 0.2% of zirconium by a predetermined proportion and the balance of iron except for unavoidable impurities. There is also a high manganese austenitic steel which is composed by adding at least one or more elements selected from a group consisting of 10% or less of nickel, 5% or less of cobalt and 10% or less of copper to the above-described high manganese austenitic steel. In addition, a high manganese austenitic steel of a different type is known which is composed by adding one or more elements selected from a group consisting of 5% or less of molybdenum and 5% or less of tungsten to the above-described high manganese austenitic steel. Furthermore, a high manganese austenitic steel is known which is composed by adding one or more elements selected from a group consisting of 10% or less of nickel, 5% or less of cobalt and 10% or less of copper and one or more elements selected from a group consisting of 5% or less of molybdenum and 5% or less of tungsten to the above-described high manganese austenitic steel.

However, the change in composition of the elements of the above-described alloys at grain boundaries which can take place when used under neutron irradiation environment has not been studied. In particular, the alloys have a problem of lowering of chromium concentration at grain boundaries which may cause deterioration in corrosion resistance and in strength.

SUMMARY OF THE INVENTION

An object of the present invention is to provide an Fe-Cr-Mn alloy in which lowering of chromium concentration in the alloy at grain boundaries due to irradiation of neutrons can be prevented, and which can be preferably used to constitute core devices or core structure members of a light-water nuclear reactor, a fast breeder reactor, a nuclear fusion reactor and the like.

In order to achieve the above-described object, according to a first aspect of the present invention, an Fe-Cr-Mn alloy is provided, which has the following composition by wt% and has a micro-structure of ferrite phase: manganese . . . 5 to 40%; chromium . . . 5 to 18%; aluminum . . . 2.0 to 12%; and the balance of iron except for unavoidable impurities.

In order to achieve the above-described object, according to a second aspect of the present invention, an Fe-Cr-Mn alloy is provided, which comprises the following elements in the following composition by wt% and has a micro-structure of ferrite phase: manganese . . . 5 to 40%; chromium . . . 5 to 18%; aluminum . . . 2.0 to 12%; one or more elements selected from a group consisting of 0.01 to 5.0% of silicon and 0.01 to 1.0% of titanium; and the balance of iron except for unavoidable impurities.

In order to achieve the above-described object, according to a third aspect of the present invention, an Fe-Cr-Mn alloy is provided, which comprises the following elements in the following composition by wt% and has a micro-structure of ferrite phase: manganese . . . 5 to 40%; chromium . . . 5 to 18%; aluminum . . . 2.0 to 12%; one or more elements selected from a group consisting of 0.01 to 5.0% of silicon and 0.01 to 1.0% of titanium; one or more elements selected from a group consisting of 0.05 to 0.5% of carbon and 0.05 to 0.3% of nitrogen; and the balance of iron except for unavoidable impurities.

In order to achieve the above-described object, according to a fourth aspect of the present invention, an Fe-Cr-Mn alloy is provided, which comprises the following elements in the following composition by wt% and has a micro-structure of ferrite phase or a mixture of ferrite and austenite: manganese . . . 5 to 40%; chromium . . . 5 to 18%; aluminum . . . 2.0 to 12%; one or more elements selected from a group consisting of 0.01 to 5.0% of silicon and 0.01 to 1.0% of titanium; one or more elements selected from a group consisting of 0.05 to 0.5% of carbon and 0.05 to 0.3% of nitrogen; one or more elements selected from a group consisting of 0.01 to 0.4% zirconium, 0.003 to 0.1% boron and 0.01 to 0.08% of phosphor; and the balance of iron except for unavoidable impurities.

In order to achieve the above-described object, according to a fifth aspect of the present invention, an Fe-Cr-Mn alloy is provided, which comprises the following elements in the following composition by wt% and has a micro-structure of a mixture of ferrite and austenite: one or more elements selected from a group consisting of 0.5% or less of carbon, 0.5% or less of nitrogen, 40% or less of manganese and nickel which meet a nickel equivalent equation of $(0.5\ Mn+Ni+30C+26\ N)\geqq 9\%$; chromium . . . 2 to 18%; aluminum . . . 2 to 12%; silicon . . . 0.01 to 5.0%; molybdenum . . . 4% or less; and the balance of iron except for unavoidable impurities. The Fe-Cr-Mn alloy of the fifth aspect can further contain 0.01 to 0.08% of phosphor.

In order to achieve the above-described object, according to a sixth aspect of the present invention, an Fe-Cr-Mn alloy is provided, which comprises the following elements in the following composition by wt% and has a micro-structure of a mixture of ferrite and austenite: one or more elements selected from a group consisting of 0.5% or less of carbon, 0.5% or less of nitrogen, 40% or less of manganese and nickel which meet a nickel equivalent equation of $(0.5\ Mn+Ni+30\ C+26\ N)\geqq 9\%$; chromium . . . 2 to 18%; aluminum . . . 2 to 12%; silicon . . . 0.01 to 5.0%; molybdenum . . . 4% or less; one or more elements selected from a group consisting of titanium, zirconium, hafnium, niobium and tantalum which meet a titanium equivalent of $0.1 \leqq (Ti+0.53\ Zr+0.27\ Hf+0.52\ Nb+0.26\ Ta)\leqq 0.4\%$; and the balance of iron except for unavoidable impurities. The Fe-Cr-Mn alloy of the sixth aspect can further contain 0.01 to 0.08% of phosphor.

The above-described alloys are alloys in which the concentration of chromium at grain boundaries is not lowered due to irradiation of neutrons at energy $E>0.1$ MeV, especially at $10^{20}n/cm^2$ or more. Furthermore, an alloy in which the concentration of chromium at grain boundaries can be raised due to irradiation of neutrons can be also obtained. Therefore, an alloy having the above-described composition according to the present invention further exhibits its improved effect of preventing lowering of concentration of chromium at grain boundaries when used in a neutron irradiation environment at $10^{20}n/cm^2$ or more ($E>0.1$ MeV).

Other and further objects, features and advantages of the invention will be appear more fully from the following description.

DETAILED DESCRIPTION OF THE INVENTION

Figure 1:
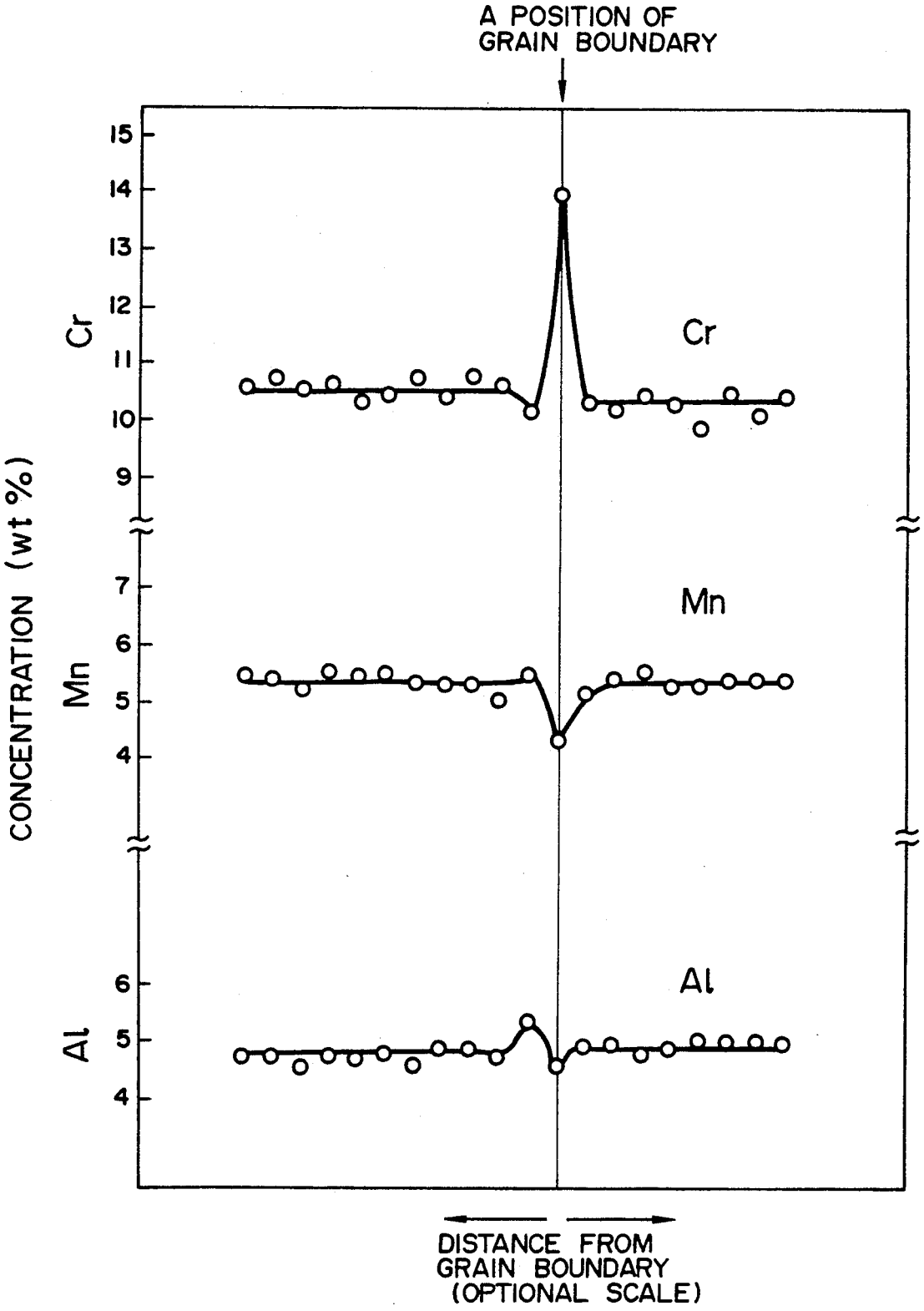
FIG. 1 illustrates the change in composition of an Fe-Cr-Mn alloy according to the present invention in the vicinity of a grain boundary due to irradiation of electrons.

According to the present invention, a given quantity of aluminum is, as a main component, added to an Fe-Cr-Mn alloy. Furthermore, practical minor elements are added to the alloy, with their quantities restricted to the degree which does not deteriorate the effect of the addition of aluminum. As a result, an alloy, in which the concentration of chromium contained at grain boundaries is not lowered or the same is raised in a neutron irradiation environment, was attained.

Functions of components of the alloy according to the present invention and capable of preventing lowering of concentration of chromium at grain boundaries will be described below.

In general, as for the change in concentration of elements in the vicinity of grain boundaries due to irradiation of high-energy particles such as neutrons, electrons and ions, the number of elements having relatively large sizes with respect to the average size of atoms contained in an alloy is reduced at grain boundaries. On the other hand, elements having relatively small sizes gather at grain boundaries. Details of the above-described phenomenon are as follows. During movement of point defects, atomic vacancies and interstitial atoms, generated in a material due to irradiation, diffuse to grain boundaries by the same quantity, and the grain boundaries acts as the sink place at which the point defects disappear, and elements the size of which is larger than the average size of the atoms contained in the alloy interact with the atomic vacancies so that the elements are substituted by the atomic vacancies. As a result, the elements having the large size move in the direction opposite to grain boundaries into which the atomic vacancies are diffused. Therefore, their concentration is lowered at grain boundaries. The elements the size of which is smaller than the average size of the atoms contained in the alloy interact with the interstitial atoms so that the elements having the small size are moved together with the interstitial atoms to grain boundaries. As a result, their concentration is raised. Thus, the concentration of dissolved atoms is changed in the vicinity of grain boundaries due to irradiation of high-energy particles such as neutrons. Actually, referring to FIGS. 2 and 4, the concentration of chromium the size of which is larger than the average size of atoms contained in the alloy is lowered. Therefore, the inventors of the present invention found a principle to relatively reduce the size of chromium atom with respect to the average size of atoms contained in an alloy by enlarging the average size of the atoms. In order to realize this, the inventors of the present invention have found a fact that it is effective to add aluminum as a result of a variety of examinations about the addition of elements having large element size and which can be soluble. Furthermore, since it was considered effective to obtain the above-described effect by enlarging the quantity of manganese, a variety of alloys having high manganese content were examined by electron-irradiation. However, if the manganese content is high, a multiplicity of precipitates containing a large quantity of manganese are formed within crystal grains. Therefore, it was impossible to prevent lowering of the density of chromium at grain boundaries by controlling substantially only the quantity of manganese.

In the alloy according to the present invention, the addition of aluminium performs a important role for preventing lowering of the density of chromium at grain boundaries due to the above-described function. Therefore, aluminum in a solid solution state must be added by a quantity exceeding a predetermined quantity. It is preferable that components made of the present alloy be subjected to a solution treatment at 1000° C. to 1200° C. for 15 to 60 minutes. Furthermore, it is also preferable that the components be subjected to a plastic working of 30% or lower reduction ratio. If the reduction ratio of the plastic working exceeds 30%, decrease of elongation of the alloy becomes excessive. It is preferable that an ingot of the alloy be subjected to hot working at 1000° C. to 1150° C. so as to make it the final material before subjected to the solution treatment. On the other hand, in the case where the Fe-Cr-Mn alloy is used as the structural material, proper mechanical strength, corrosion resistance, oxidation resistance and swelling resistance are required. A variety of actual elements added for the purpose of realizing the above-described requirements must be restricted to the quantity which does not deteriorate the effect of addition of aluminum. Therefore, the composition of the alloy according to the present invention is restricted as follows;

Al; In order to prevent depletion of chromium atoms at grain boundaries due to irradiation of particles such as neutrons, the quantity of addition of aluminum must be 2% (weight percent to be common hereinafter) or more. If it exceeds 12%, precipitations of coarse aluminum compounds may cause excessive brittleness. Furthermore, cracks take place at hot working and cold working. Therefore, the range of addition of aluminum is determined to be 2% or more to 12% or less, preferably 3 to 6%, more preferably 4.5 to 6%.

Mn; Manganese must be added by 5% or more in order to improve the effect of aluminum. In a case where the alloy according to the present invention is mainly in a ferritic structure and in a case where it is mainly an austenitic structure, coarse precipitations of manganese compounds are generated and excessive brittleness takes place if the content exceeds 40%. Therefore, the range of manganese content is determined to be 5 to 40%, preferably 5 to 10% or 20 to 30%. If the alloy containing 10 to 20% of manganese is heated to 450° C. to 600° C., impact value of the alloy is reduced.

Cr; In order to maintain an excellent corrosion resistance, the content must be 5% or more. If it exceeds 18%, precipitations may be formed in association with aluminum. Furthermore, $\sigma$-phase may be formed, and the alloy thereby become brittle. Therefore, it is determined between 5 and 18%. It is preferable that the content be 7 to 12% since excessive brittleness due to forming of $\sigma$-phase takes place at high chromium content in a case where the alloy according to the present invention, further preferably 12 to 18% in order to improve corrosion resistance in the case where the alloy according to the present invention is an alloy including austenite phase.

Si; It is effective to add silicon by 0.01% or more for the purpose of improving oxidation resistance. If it exceeds 5%, a variety of precipitates are formed in association with Ti, Zr, Ta, N (nitrogen), Ni and/or the like. Therefore, the effect of the addition of silicon may be lost. Furthermore, $\sigma$-phase can be easily formed in association with Fe and/or Cr, causing brittleness to take place easily. Therefore, the range of addition of silicon is determined between 0.01 to 5%, preferably 0.1 to 2%.

Ti; It is effective to add titanium by 0.01% or more for the purpose of improving oxidation resistance of the alloy according to the present invention. If the content exceeds 1.0%, coarse precipitates are induced by an irradiation with silicon and the like, causing brittleness to be made excessive. Therefore, the quantity is determined between 0.01 to 1.0%. In a case of the alloy of mixed structure of austenite and ferrite containing nickel according to the present invention, titanium must be added by 0.1% or more for the purpose of maintaining swelling resistance. If the quantity exceeds 0.4%, coarse precipitates are induced by irradiation with C (carbon), N (Nitrogen), silicon and the like, causing brittleness to be made excessive. Furthermore, its weldability may be deteriorated excessively. Therefore, the range of the addition of titanium is determined between 0.1 and 0.4%.

Zr, Hf, Nb and Ta; These elements must be added by a quantity with which Ti equivalent $=(0.53\ Zr+0.27\ Hf+0.52\ Nb+0.26\ Ta)$ becomes 0.1% or more for the purpose of maintaining an excellent swelling resistance in the case where the alloy according to the present invention is a safety mixed structure of austenite and ferrite containing nickel. If the content exceeds 0.4%, brittleness resistance and weldability excessively deteriorate because of the same reason in the above-described case of titanium. Therefore, one or more type of the above-described elements must be added such that Ti equivalent becomes 0.1 to 0.4%. Zirconium is an element for improving high temperature strength in the alloy according to the present invention having ferritic structure. It is effective to add Zirconium by a quantity of 0.01% or more of Ti equivalent. If the quantity exceeds 0.4%, it is not preferable because of the same reason as the above-described case.

B; It is effective to add boron by 0.003% or more for the purpose of improving grain boundary strength, facilitating the fining of the crystal grains and improving ductility at high temperatures. Boron is an element which generates He as a result of a reaction ${}_5H^{10}+{}_0n^1\rightarrow{}_2He^4+{}_3Li^7$ due to irradiation of thermal neutrons. Therefore, brittleness of grain boundaries due to generation of He (helium) becomes excessive under the neutron irradiation environment if the quantity exceeds 0.1%. Therefore, it is preferable that boron be added by 0.1% or less.

P; Since the addition of phosphor by 0.01% or more causes swelling resistance to be improved, phosphor may be contained. However, the quantity exceeds 0.08%, brittleness becomes excessive. Therefore, it is preferable that the quantity be 0.08% or less.

Mo; It is preferable for increasing mechanical strength that molybdenum be added. If the quantity of the addition of molybdenum exceeds 4.0%, $\sigma$-phase and Laves phase can be formed excessively, causing brittleness. Therefore, the upper limitation of addition of it is determined to be 4.0%.

C and N; It is effective to respectively add C (carbon) and N (nitrogen) by 0.01% or more for increasing mechanical strength. If C and N are respectively added by 0.3% and 0.5%, brittleness becomes excessive due to the forming of coarse nitrides and carbides. Therefore, it is determined that N is added by 0.001 to 0.3% and C is added by 0.001 to 0.5%, preferably C is added by 0.01 to 0.15% and N is added by 0.01 to 0.15%.

Ni; It is effective for a purpose of improving ductility to add nickel so that Ni equivalent =(Ni +0.5 Mn +30 C +26 N) becomes 9% or more substituting by one or more element selected from a group consisting of Mn, C and N, preferably 15% or less, further preferably 2 to 15%.

In the above-described range of addition of the practical elements, the effect of prevention of chromium depletion at grain boundaries induced by irradiation high-energy particles such as neutrons due to adding aluminum cannot be hindered.

Furthermore, the addition of aluminum may also be effective to maintain good oxidation resistance of the alloy according to the present invention. In addition, in the case where content of oxygen is high in the alloy according to the present invention, dispersion strengthening can be realized as a result of forming of alumina. The similar strengthening may be realized by zirconium contained in the alloy according to the present invention.

EXAMPLE 1

FIG. 1 is a graph which illustrates the change in the composition of an alloy according to the present invention in the vicinity of grain boundaries by electron irradiation, the alloy being composed by adding 4.8 wt% of aluminum to an alloy composed of 0.01% of C, 10% of Cr, 0.3% of Si, 5% of Mn and the balance of Fe (by weight percent). The above-described irradiation was performed in such a manner that electrons are irradiated simulating the irradiation of neutrons at temperature of 723K to a dose of 10 dpa, where 1 dpa corresponds to the quantity of irradiations of neutrons of about $1\times10^{21}$ n/cm$^2$. The composition is not changed in the vicinity of grain boundaries before electrons are irradiated. Lowering of the density of chromium at grain boundaries is prevented by the above-described irradiation. On the contrary, the density of chromium can be raised by about 30% in comparison to the state before the irradiation (the same concentration level as that in the matrix). The alloy according to this example was subjected to hot forging at 1150° C. after vacuum melting. Then, it was subjected to a solution treatment at 1050° C. to 1150° C. before repeatedly subjected to rolling and annealing. Then, it was subjected to a solution treatment at 1150° C. for 15 minutes as the final processing, the solution treatment being a treatment in which it was heated before cleaned with water.

Figure 2:
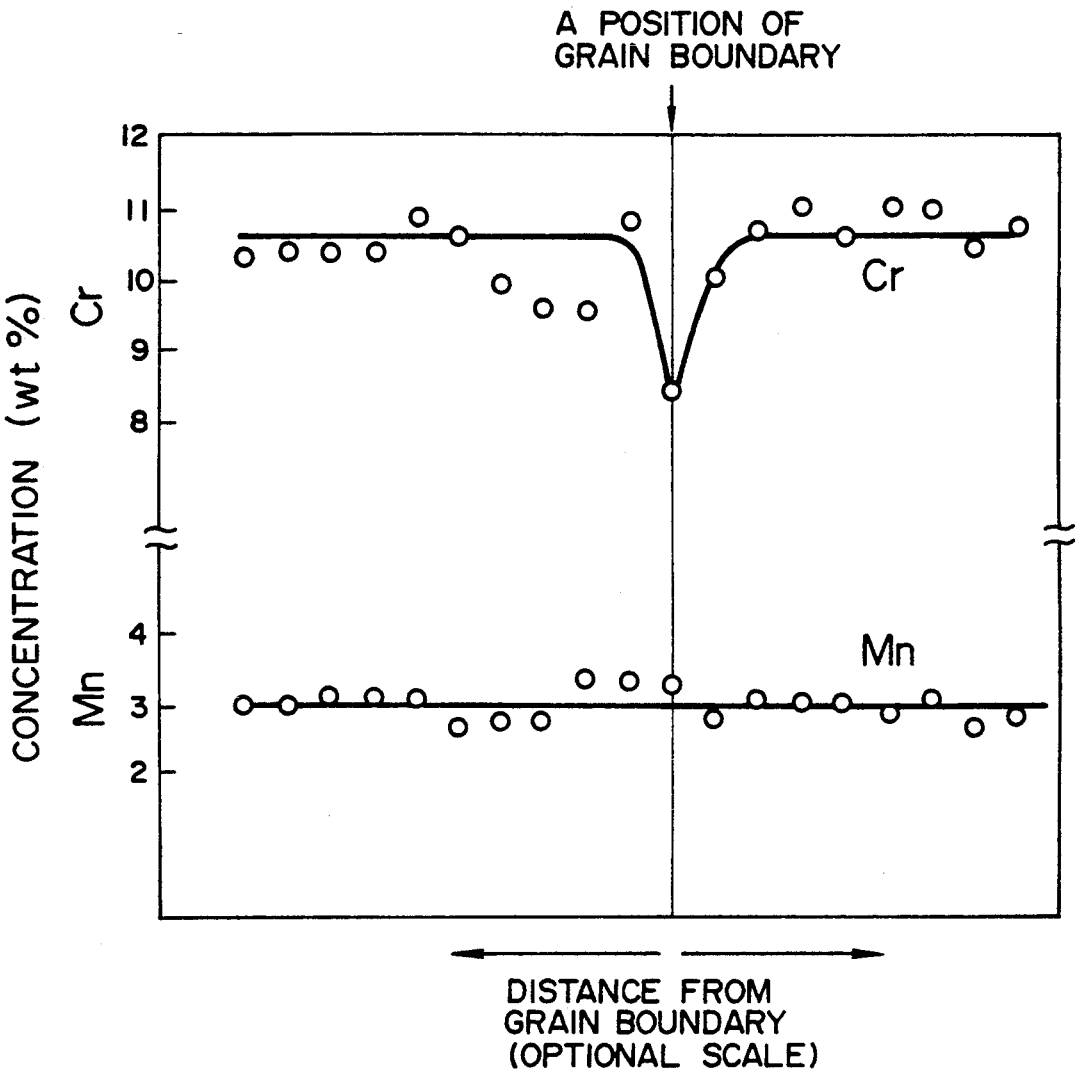
FIG. 2 illustrates the change in composition of comparative alloys in the vicinity of a grain boundary due to irradiation of electrons.
Figure 3:
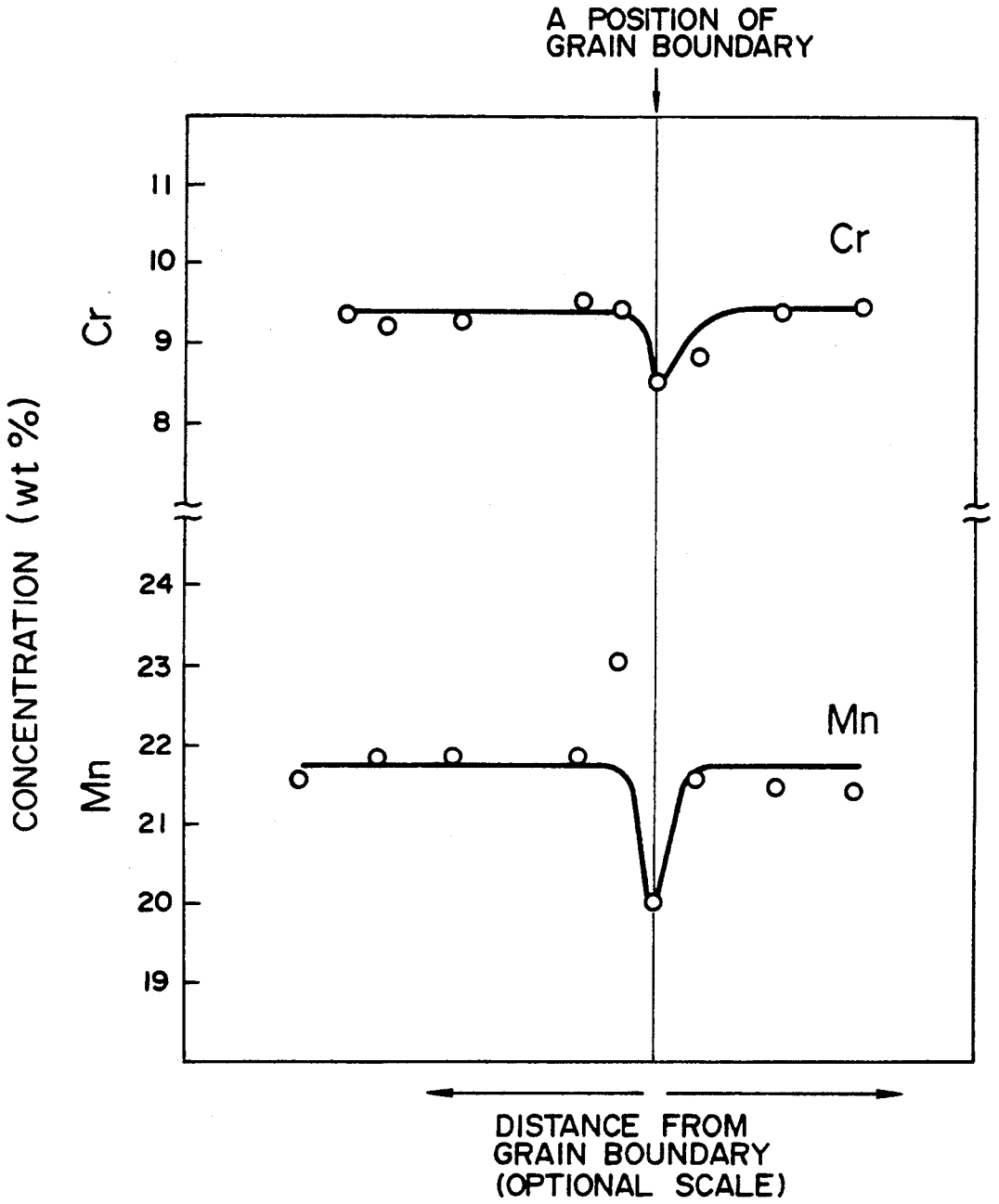
FIG. 3 illustrates the change in composition of an alloy of the present invention in the vicinity of a grain boundary due to irradiation of electrons.
Figure 4:
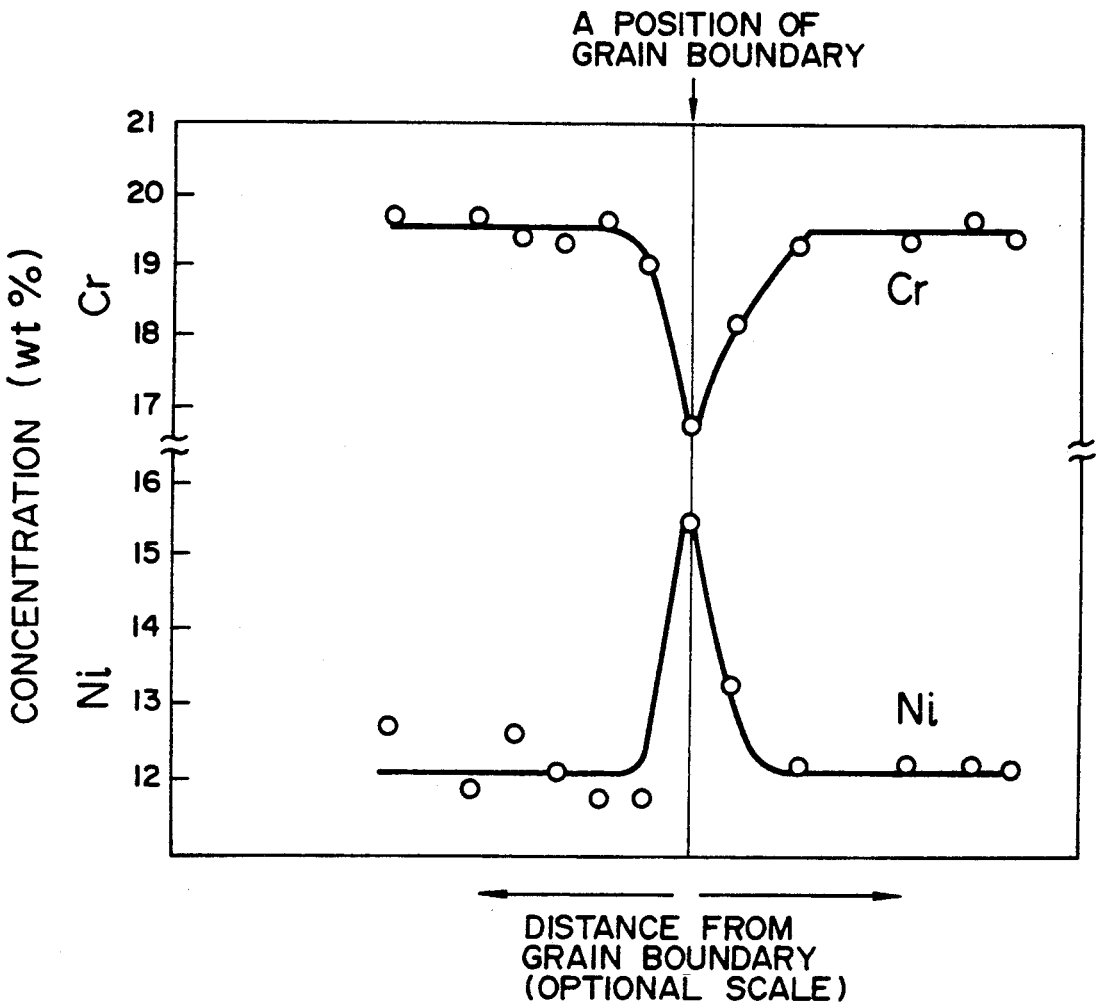
FIG. 4 illustrates the change in composition of a comparative alloy in the vicinity of a grain boundary due to irradiation of electrons.

FIGS. 2 and 4 are graphs which illustrate a comparative alloy manufactured by a method similar to the above-described preparing process, in which the concentration of chromium at grain boundaries was lowered due to irradiation of electrons is illustrated. FIG. 2 illustrates the change in composition in the vicinity of a grain boundary when an Fe - 10 Cr - 3 Mn alloy was irradiated with electrons. Referring to this drawing, an alloy, the composition of which is similar to the alloy shown in FIG. 1 and in which no aluminum was added, was irradiated with electrons. The electrons irradiation conditions were the same as those in the case shown in FIG. 1. As is apparent from the above, the concentration of chromium was lowered at grain boundaries. Therefore, it can be understood that the addition of aluminum prevents the lowering of the concentration of chromium at grain boundaries (see FIG. 1). FIG. 3 is a graph which illustrates the results of irradiating, with electrons, a Fe - 10 Cr - 22 Mn alloy of the present invention which is composed of four basic elements of Fe, Cr, Mn and 3.0 wt% of aluminum. In this alloy, the quantity of chromium was lowered by 1 wt% in at a grain boundary, but the chromium depletion is very low so that the example concerns this invention. FIG. 4 is a graph which illustrates the change in the composition in the vicinity of a grain boundary when JIS SUS316L steel, which is a conventional steel for use in a core portion of a light-water nuclear reactor, was irradiated by electrons at 723K up to 30 dpa. As is shown, the concentration of chromium was lowered at a grain boundary, while nickel concentration was raised in the same portion.

EXAMPLE 2

Figure 5:
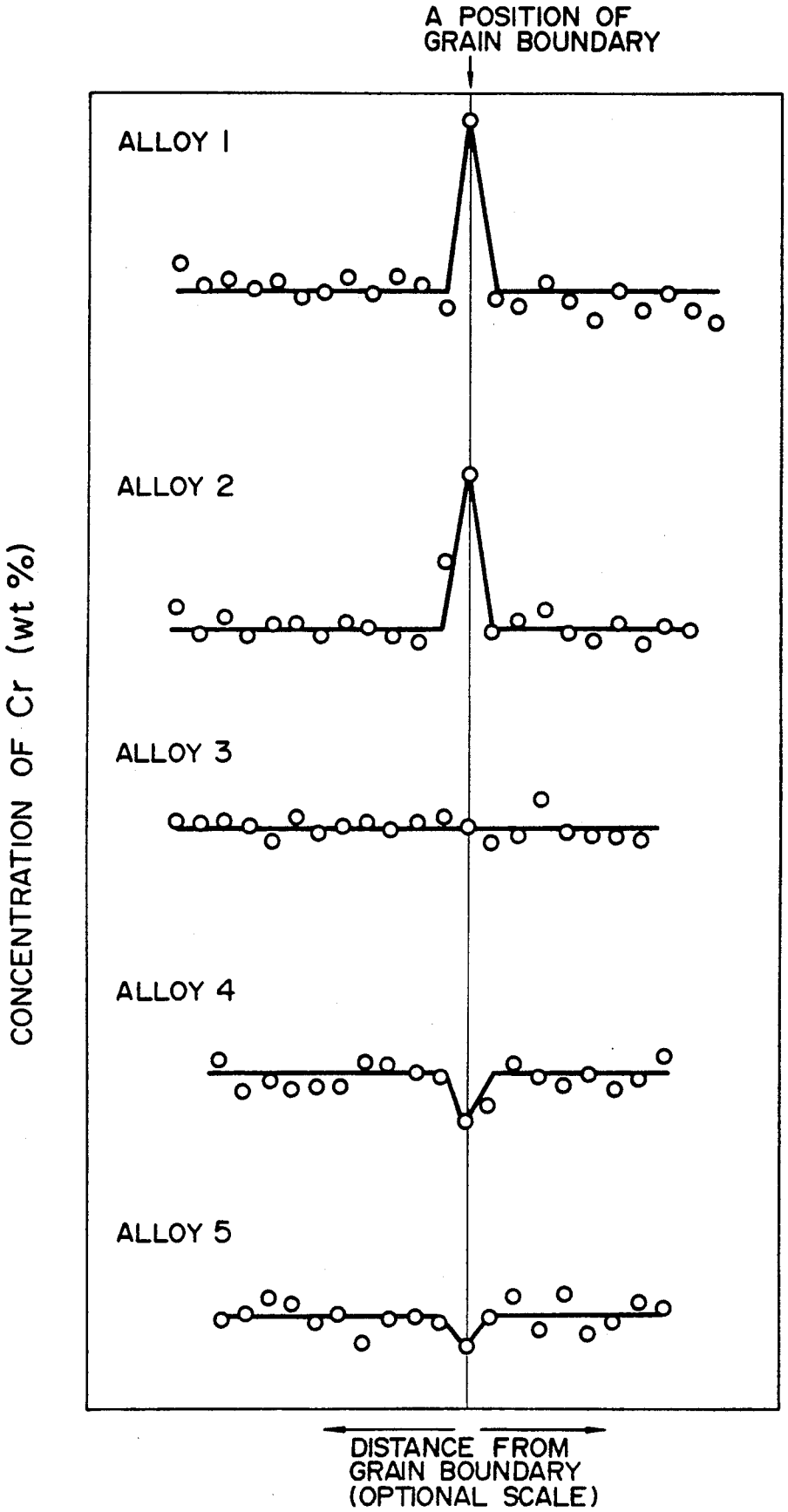
FIG. 5 illustrates the change in the concentration of chromium contained in alloys according to the present invention and that contained in the comparative alloys in the vicinity of a grain boundary due to irradiation of electrons.

Table 1 shows the chemical composition (by weight percent) of alloys (Nos. 1 to 7) according to the present invention and comparative alloys (Nos. 8 to 10). FIG. 5 is a graph which illustrates the results of the change in concentration of chromium in the vicinity of a grain boundary when the alloys shown in Table 1 were irradiated with electrons, the examination being made by using an energy dispersion type X-ray spectrum analyzer. The above-described alloy were manufactured by the same method as those according to the Example 1. Irradiation was performed by employing an electron irradiation simulating neutron irradiation at 723 K to a dose of 10 pda (which corresponds to $10^{22}$n/cm$^2$ in neutron irradiation). In any one of the alloys, there is no concentration difference of chromium between at a grain boundary and within grains before irradiation. However, concentration of chromium at a grain boundary was raised due to irradiation (Nos. 1 and 2) or lowering of concentration of chromium at a grain boundary was prevented (No. 3).

On the other hand, in the alloys (Nos. 4 and 5) of the present invention containing 20% or more of manganese, although concentration of chromium at a grain boundary was slightly lowered as a result of addition of aluminum by the same quantity, the quantity of lowering was considerably reduced to 1% or less. The comparative alloys Nos. 8 to 10 displayed the lowering of the concentration of chromium by 2% or more. According to this example, nickel was contained as unavoidable impurity. The alloy Nos. 1 to 3 and 6 are alloys each having a complete ferritic structure. Each of the alloys Nos. 4, 5 and 7 has about 3% area of residual austenite, while each of the comparative alloys Nos. 8 to 10 has a complete austenitic structure.

TABLE 1

| | (wt %) | | | | | | | | | | |
|---|---|---|---|---|---|---|---|---|---|---|---|
| No. | C | Si | Mn | P | S | Ni | Cr | Al | N | O | Change in the concentration of CR at grain boundaries |
| Alloy according to the present invention | | | | | | | | | | | |
| 1 | 0.002 | <0.01 | 5.06 | 0.003 | 0.004 | 0.01 | 10.29 | 4.21 | 0.0012 | 0.0004 | ◎ |

TABLE 1-continued

| No. | C | Si | Mn | P | S | Ni | Cr | Al | N | O | Change in the concentration of CR at grain boundaries |
|---|---|---|---|---|---|---|---|---|---|---|---|
| | | | | | | (wt %) | | | | | |
| 2 | 0.003 | <0.01 | 9.88 | 0.004 | 0.005 | 0.01 | 10.08 | 4.39 | 0.0024 | 0.0002 | ◎ |
| 3 | 0.005 | <0.01 | 15.03 | 0.003 | 0.007 | 0.01 | 10.22 | 4.53 | 0.0018 | 0.0004 | ○ |
| 4 | 0.003 | <0.01 | 22.77 | 0.003 | 0.008 | 0.01 | 10.07 | 4.44 | 0.0020 | 0.0004 | Δ |
| 5 | 0.004 | <0.01 | 24.73 | 0.003 | 0.009 | 0.01 | 9.85 | 4.27 | 0.0024 | 0.0003 | Δ |
| 6 | 0.003 | <0.01 | 5.18 | 0.003 | 0.004 | 0.01 | 10.15 | 2.01 | 0.0014 | 0.0004 | ○ |
| 7 | 0.003 | <0.01 | 25.50 | 0.003 | 0.005 | 0.01 | 10.09 | 2.09 | 0.0020 | 0.0003 | ○ |
| Comparative alloy | | | | | | | | | | | |
| 8 | 0.103 | <0.01 | 15.20 | 0.003 | 0.003 | 0.01 | 10.07 | 0.03 | 0.0018 | 0.0112 | X |
| 9 | 0.002 | <0.01 | 20.41 | 0.003 | 0.005 | 0.01 | 10.13 | 0.10 | 0.0019 | 0.0097 | X |
| 10 | 0.002 | <0.01 | 25.43 | 0.004 | 0.006 | 0.01 | 10.08 | 0.08 | 0.0013 | 0.0125 | X |

(◎: raised, ○: no change, Δ: lowered by 1% or less, X: lowered by 2% or more)

EMBODIMENT 3

Table 2 shows, together with a comparative alloy (No. 5), the chemical composition of each of the alloys (Nos. 1 to 4) which contain Si and/or Ti according to the present invention. Table 2 also shows the change in concentration of chromium at grain boundaries due to electron irradiation performed similarly to that performed in Embodiment 1. In the case where Si and/or Ti is contained, depletion of chromium at grain boundaries due to irradiation was prevented by addition of aluminum. According to this example, C and N were contained as unavoidable impurities. The alloys according to this example are alloys having ferritic structure.

TABLE 2

| Alloy No. | C | Si | Mn | Cr | Al | Ti | N | Change in the concentration of Cr at grain boundaries |
|---|---|---|---|---|---|---|---|---|
| | | | | | (wt %) | | | |
| Alloy according to the present invention | | | | | | | | |
| 1 | 0.01 | 0.4 | 10.03 | 10.92 | 4.41 | — | 0.001 | ◎ |
| 2 | 0.01 | — | 10.12 | 10.14 | 5.48 | 0.20 | 0.002 | ◎ |
| 2 | 0.01 | 0.3 | 9.87 | 10.02 | 4.50 | 0.11 | 0.002 | ◎ |
| 4 | 0.01 | 0.4 | 18.04 | 10.01 | 4.33 | 0.28 | 0.001 | ○ |
| Comparative alloy | | | | | | | | |
| 5 | 0.01 | 0.3 | 10.53 | 10.25 | — | 0.24 | 0.001 | X |

(Fe; the balance)
◎; raised due to irradiation
○; concentration was not lowered
X; concentration was lowered

EMBODIMENT 4

Table 3 shows, together with comparative alloys (Nos. 7 to 10 and Nos. 15 and 16), the alloys (Nos. 1 to 6, Nos. 11 to 14 and Nos. 17 to 20) according to the present invention. Table 3 also shows the change in concentration of chromium at grain boundaries due to the irradiation performed similarly to that performed in Embodiment 1. The alloys (Nos. 1 to 6) according to the present invention have a mixed structure of austenite and ferrite or ferrite, and one or more elements selected from a group consisting of Si and Ti are contained by a predetermined quantity. The alloys (Nos. 11 to 14) further contain one or more elements selected from a group consisting of Zr, B and P by a predetermined quantity. In the above-described alloys, the addition of aluminum by a quantity of 2.0 wt% or more is effective to prevent lowering of concentration of chromium at grain boundaries due to irradiation. All of the alloys (except for Nos. 7 to 10) shown in Table 3 are alloys each having a mixed structure of ferrite and austenite including ferrite by about 10 to 25 vol% or having ferrite. The quantity of ferrite in the mixed structure was 10 to 25% in area.

TABLE 3

| Alloy No. | C | Si | P | Mn | Cr | Al | Ti | Zr | N | B | Change in the concentration of cr at grain boundaries | Micro Structure |
|---|---|---|---|---|---|---|---|---|---|---|---|---|
| | | | | | (Fe: the balance) (wt %) | | | | | | | |
| Alloy according to the present invention | | | | | | | | | | | | |
| 1 | 0.27 | 2.1 | 0.001 | 9.2 | 7.5 | 5.3 | 0.3 | — | 0.01 | — | ◎ | Ferrite & Austenite |
| 2 | 0.008 | 0.3 | 0.008 | 13.2 | 10.2 | 5.5 | 0.3 | — | 0.20 | — | ○ | Ferrite |
| 3 | 0.10 | 0.3 | 0.010 | 8.5 | 11.2 | 5.2 | 0.3 | — | 0.12 | — | ◎ | " |
| 4 | 0.09 | 0.4 | 0.009 | 15.8 | 9.3 | 5.8 | 0.3 | — | 0.21 | — | ○ | " |
| 5 | 0.11 | 0.2 | 0.007 | 25.3 | 10.0 | 11.4 | 0.3 | — | 0.02 | — | ◎ | " |
| 6 | 0.12 | 0.2 | 0.003 | 38.9 | 8.9 | 6.0 | 0.3 | — | 0.18 | — | ○ | " |
| Comparative alloy | | | | | | | | | | | | |
| 7 | 0.11 | 0.2 | 0.002 | 10.2 | 12.0 | 0.02 | 0.3 | — | 0.23 | — | X | Austenite |
| 8 | 0.12 | 0.3 | 0.003 | 14.8 | 11.4 | 0.31 | 0.3 | — | 0.20 | — | X | " |
| 9 | 0.10 | 0.2 | 0.008 | 26.8 | 11.3 | 0.3 | 0.3 | — | 0.20 | — | X | " |

TABLE 3-continued

| Alloy No. | C | Si | P | Mn | Cr | Al | Ti | Zr | N | B | Change in the concentration of cr at grain boundaries | Micro Structure |
|---|---|---|---|---|---|---|---|---|---|---|---|---|
| | (Fe: the balance) (wt %) | | | | | | | | | | | |
| 10 | 0.09 | 0.2 | 0.010 | 39.8 | 10.8 | 0.4 | 0.3 | — | 0.21 | — | X | " |
| Alloy according to the present invention | | | | | | | | | | | | |
| 11 | 0.12 | 0.2 | 0.009 | 12.0 | 10.8 | 6.0 | 0.3 | 0.2 | 0.20 | — | ◎ | Ferrite & Austenite |
| 12 | 0.13 | 0.5 | 0.01 | 12.2 | 9.9 | 5.1 | 0.3 | — | 0.20 | 0.004 | ◎ | " |
| 13 | 0.09 | 0.4 | 0.03 | 11.2 | 10.1 | 5.3 | 0.3 | — | 0.21 | — | ◎ | " |
| 14 | 0.20 | 0.2 | 0.02 | 10.8 | 9.8 | 7.2 | 0.3 | 0.4 | 0.03 | 0.005 | ◎ | " |
| Comparative alloy | | | | | | | | | | | | |
| 15 | 0.19 | 0.5 | 0.01 | 10.4 | 9.0 | 0.01 | 0.3 | 0.1 | 0.22 | 0.003 | X | " |
| 16 | 0.21 | 0.2 | 0.02 | 10.8 | 9.5 | 1.0 | 0.3 | 0.2 | 0.23 | 0.003 | X | " |
| Alloy according to the present invention | | | | | | | | | | | | |
| 17 | 0.20 | 0.01 | 0.010 | 5.8 | 10.01 | 2.0 | 0.3 | — | 0.01 | — | ○ | " |
| 18 | 0.009 | 0.20 | 0.008 | 10.9 | 10.23 | 2.8 | 0.3 | — | 0.01 | — | ○ | Ferrite |
| 19 | 0.10 | 0.10 | 0.009 | 21.0 | 9.98 | 2.9 | 0.2 | 0.2 | 0.01 | — | ○ | Ferrite & Austenite |
| 20 | 0.010 | 2.82 | 0.007 | 26.0 | 10.51 | 3.4 | 0.2 | 0.2 | 0.20 | — | ○ | " |

(◎; raised due to irradiation, ○; concentration was not lowered, X; concentration was lowered by 2% or more)

EMBODIMENT 5

Table 4 shows, together with comparative alloys (Nos. 21 to 24), the alloys (Nos. 1 to 20 and Nos. 25 to 27) according to the present invention. Table 3 also shows the change in concentration of Cr at grain boundaries due to irradiation performed similarly to that performed in Embodiment 1. In the alloys Nos. 1 to 12 according to the present invention and prepared by substituting Mn and C or N by Ni, the lowering of concentration of Cr at grain boundaries due to the irradiation was prevented. In the alloys Nos. 13 to 20 according to the present invention and prepared by further adding one or more elements selected from a group consisting of Ti, Zr, Hf, Nb and Ta by a predetermined quantity, depletion of Cr concentration was prevented. As is shown, although a variety of elements are added, the effect of addition of aluminum according to the present invention can be obtained. The alloys Nos. 1 to 12, Nos. 14 to 20 and Nos. 26 and 27 have mixed structure of ferrite and austenite. The quantity of ferrite of each of the alloys Nos. 1 to 12 and Nos. 14 to 20 was 10 to 30% by area, while the alloys Nos. 26 and 27 contain ferrite by 50% by area. The alloys Nos. 13 and 25 are the alloys of complete ferritic structure, while the alloys Nos. 21 to 24 are alloys of complete austenitic structure.

TABLE 4

| Alloy No. | C | Si | P | Mn | Ni | Cr | Mo | Al | N | Ti | Zr | Hf | Nb | Ta | Change in the concentration of Cr at grain boundaries |
|---|---|---|---|---|---|---|---|---|---|---|---|---|---|---|---|
| | (wt %) | | | | | | | | | | | | | | |
| Alloy according to the present invention | | | | | | | | | | | | | | | |
| 1 | 0.07 | 0.5 | 0.02 | 25.0 | 3.0 | 11.0 | 2.2 | 5.0 | 0.01 | | | | | | ○ |
| 2 | 0.01 | 0.5 | 0.02 | 25.1 | 3.0 | 11.1 | 2.1 | 5.1 | 0.07 | | | | | | ○ |
| 3 | 0.05 | 0.5 | 0.02 | 25.4 | 3.0 | 10.8 | 2.3 | 5.1 | 0.02 | | | | | | ○ |
| 4 | 0.05 | 0.5 | 0.02 | 24.8 | 3.0 | 10.5 | 2.0 | 5.2 | 0.02 | | | | | | ○ |
| 5 | 0.07 | 0.5 | 0.02 | 5.0 | 13.9 | 17.1 | 2.0 | 5.8 | 0.01 | | | | | | ◎ |
| 6 | 0.01 | 0.5 | 0.02 | 5.1 | 13.7 | 17.4 | 2.1 | 5.0 | 0.07 | | | | | | ◎ |
| 7 | 0.05 | 0.5 | 0.02 | 5.0 | 13.9 | 17.3 | 2.2 | 5.9 | 0.02 | | | | | | ◎ |
| 8 | 0.05 | 0.5 | 0.02 | 5.2 | 13.8 | 17.0 | 2.1 | 5.8 | 0.02 | | | | | | ◎ |
| 9 | 0.06 | 0.5 | 0.01 | 10.1 | 9.8 | 13.5 | 2.0 | 5.0 | 0.01 | | | | | | ◎ |
| 10 | 0.01 | 0.5 | 0.02 | 10.2 | 9.8 | 13.2 | 2.1 | 5.3 | 0.07 | | | | | | ◎ |
| 11 | 0.05 | 0.5 | 0.02 | 10.1 | 9.9 | 13.1 | 2.2 | 5.9 | 0.01 | | | | | | ◎ |
| 12 | 0.05 | 0.5 | 0.02 | 10.3 | 9.7 | 13.1 | 2.2 | 5.8 | 0.02 | | | | | | ◎ |
| 13 | 0.01 | 0.5 | 0.02 | 25.5 | 3.0 | 10.4 | 2.0 | 5.0 | 0.01 | 0.3 | | | | | ○ |
| 14 | 0.07 | 0.5 | 0.02 | 10.3 | 9.9 | 13.2 | 2.2 | 5.2 | 0.01 | 0.3 | | | | | ◎ |
| 15 | 0.01 | 0.5 | 0.02 | 5.2 | 13.8 | 17.5 | 2.2 | 5.9 | 0.01 | 0.2 | 0.2 | | | | ◎ |
| 16 | 0.07 | 0.5 | 0.01 | 5.2 | 14.0 | 17.4 | 2.2 | 5.3 | 0.01 | 0.2 | 0.1 | | 0.2 | | ◎ |
| 17 | 0.01 | 0.5 | 0.01 | 5.3 | 13.8 | 17.2 | 2.2 | 5.3 | 0.01 | 0.2 | | 0.3 | | | ◎ |
| 18 | 0.07 | 0.5 | 0.02 | 10.0 | 9.7 | 13.6 | 2.2 | 5.4 | 0.01 | 0.2 | | 0.3 | | | ◎ |
| 19 | 0.01 | 0.5 | 0.02 | 5.2 | 14.0 | 17.2 | 2.2 | 5.1 | 0.01 | 0.2 | | | | 0.3 | ◎ |
| 20 | 0.06 | 0.5 | 0.02 | 28.0 | 2.0 | 9.0 | 2.2 | 5.3 | 0.01 | 0.2 | | | | 0.3 | ○ |
| Comparative Alloy | | | | | | | | | | | | | | | |
| 21 | 0.01 | 0.5 | 0.02 | 25.2 | 3.0 | 10.9 | 2.2 | 0.01 | 0.02 | | | | | | X |
| 22 | 0.05 | 0.5 | 0.02 | 10.0 | 9.7 | 13.4 | 2.2 | 1.8 | 0.01 | | | | | | X |
| 23 | 0.02 | 0.5 | 0.02 | 25.0 | 3.1 | 10.5 | 2.2 | 0.01 | 0.03 | 0.2 | 0.2 | | | | X |
| 24 | 0.05 | 0.5 | 0.02 | 10.0 | 9.2 | 13.7 | 2.2 | 1.0 | 0.01 | 0.2 | 0.1 | | 0.3 | | X |
| Present invention | | | | | | | | | | | | | | | |
| 25 | 0.01 | 0.5 | 0.01 | 25.1 | 3.0 | 10.8 | 2.2 | 2.0 | 0.01 | | | | | | ○ |
| 26 | 0.06 | 0.5 | 0.02 | 10.2 | 13.8 | 11.0 | 2.2 | 3.1 | 0.01 | 0.2 | 0.2 | | | | ○ |
| 27 | 0.03 | 0.5 | 0.01 | 5.3 | 9.8 | 11.3 | 2.3 | 2.3 | 0.01 | 0.2 | | 0.1 | | | ○ |

(◎; concentration increased, ○; no lowering of concentration, X; concentration lowered by 2% or more)

Then, an example of an apparatus in which the alloy according to the present invention is used will be described.

Figure 6:
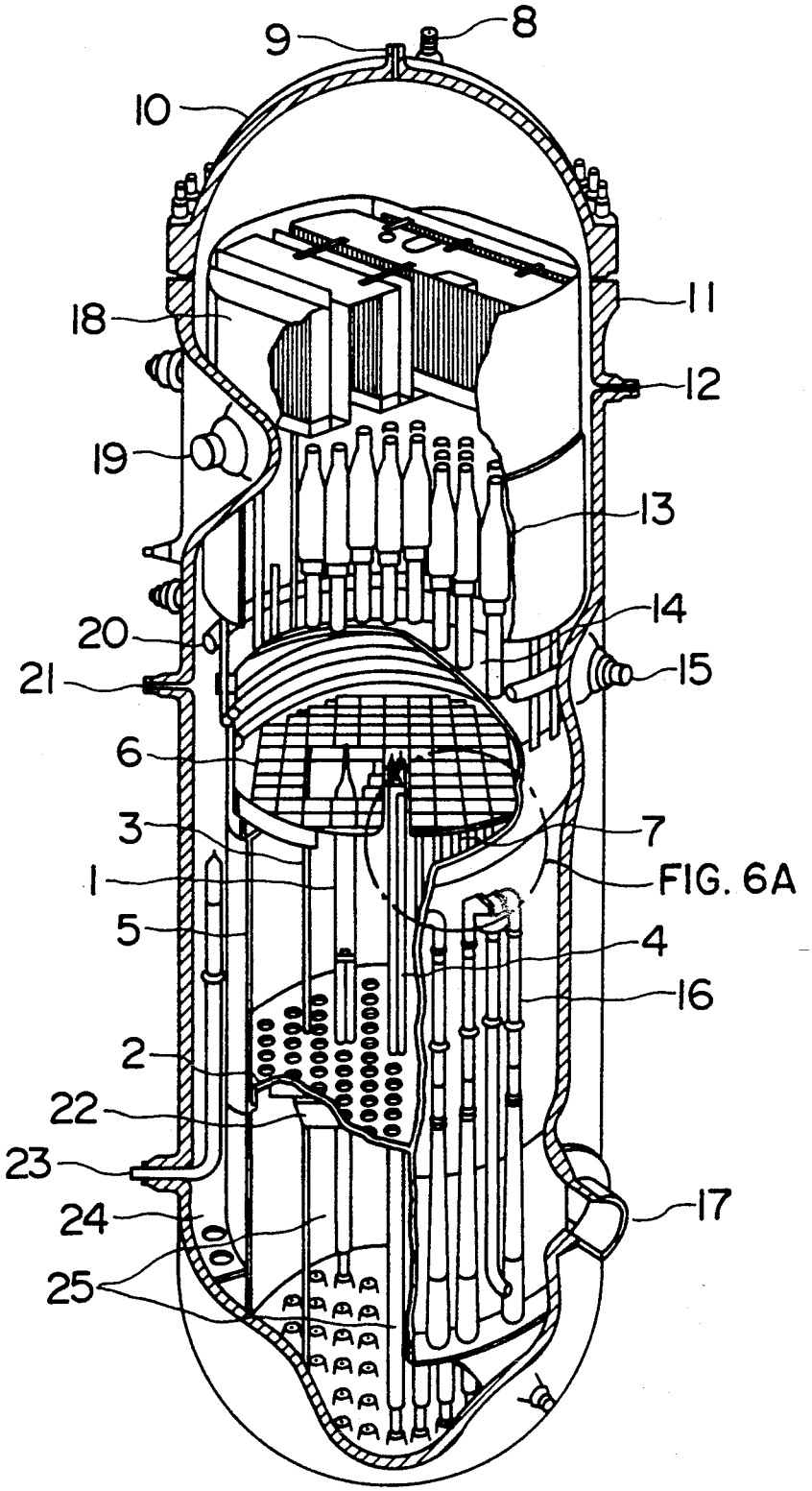
FIG. 6 is a cut away perspective view of a core of a boiling water reactor.
Figure 6A:
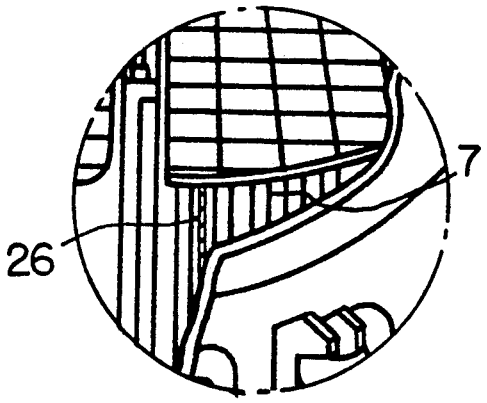
FIG. 6A is an enlarged view of a portion of FIG. 6.

FIG. 6 is a schematic perspective cut away view which illustrates a core portion of an essential portion of a boiling water type light-water nuclear reactor (BWR) nd FIG. 6A is an enlarged view of a portion of FIG. 6 showing a section of a channel box. Referring to the drawing, reference numeral 1 represents a neutron source pipe, 2 a core supporting plate, 3 a neutron instrumentation pipe, 4 a control rod, 5 a shroud and 6 an upper lattice plate. Those members and devices constitute the core of the light water nuclear reactor and are used in water in which a large quantity of neutrons are irradiated at high temperature of 288° C. and high pressure of 7 MPa. Concentration of chromium at grain boundaries can be raised due to neutron irradiation by producing the members and devices with an Fe-Cr-Mn alloy according to the present invention. Therefore, corrosion resistance of those can be improved. In addition to the members and devices shown in FIG. 6, the alloy according to the present invention may be applied to component parts in vicinities of those members and devices. Also in this case, the similar effect can be obtained.

Furthermore, the alloy according to the present invention may be applied to constituent members and devices of a core portion of a water cooling type nuclear reactor except for a boiling water type reactor. In this case, the similar effect can be obtained.

In the case where the alloy according to the present invention stated in examples 1 to 4 is employed to make the neutron source pipe 1, the neutron instrumentation pipe 3, a control rod insertion pipe and the channel box 26 (see FIG. 6A) for a fuel assembly and a fuel cladding pipe 7, excellent stress corrosion cracking (SCC) resistance to neutron irradiation can be obtained. Those members can be obtained from an ingot of the alloy according to the present invention by a process of hot working and a repetition of cold working and annealing after solution treatment.

The core supporting plate 2, the shroud 5, and the upper lattice plate 6 can be obtained from an ingot of the alloy according to the present invention by performing hot working and solution treatment.

Furthermore, the core is constituted by the following devices or elements which may be made of the alloy according to the present invention; an upper mirror spray nozzle 8; a bent nozzle 9; a pressure vessel cover 10; a pressure vessel flange 11; a measuring nozzle 12; a steam separator 13; a shroud head 14; a supply water inlet nozzle 15; a jet pump 16; a recycling water outlet nozzle 17; a steam dryer 18; a steam outlet nozzle 19; a water supply supercharger 20; a core spraying nozzle 21; a lower core lattice 22; a recycling water inlet port nozzle 23; a baffle plate 24; and a control rod guide pipe 25.

The alloy according to the present invention may be employed in an advanced inverter (ABWR) and a pressurized water reactor (PWR). The core of the ABWR comprise an internal pump as an alternative to the jet pump 16 of the above-described BWR. The other structure is arranged to be similar to that of BWR. Therefore, the alloy according to the present invention may be applied to the core elements and devices of the ABWR similarly to the elements and the devices for the BWR. As a result of the employment of the alloy according to the present invention, the safety can be improved significantly.

Figure 7A:
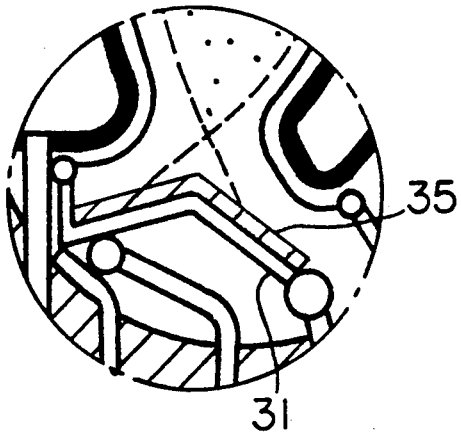
FIG. 7 is a cross sectional view which illustrates a nuclear fusion reactor and FIG. 7A is an enlarged view of a portion of FIG. 7.
Figure 7:
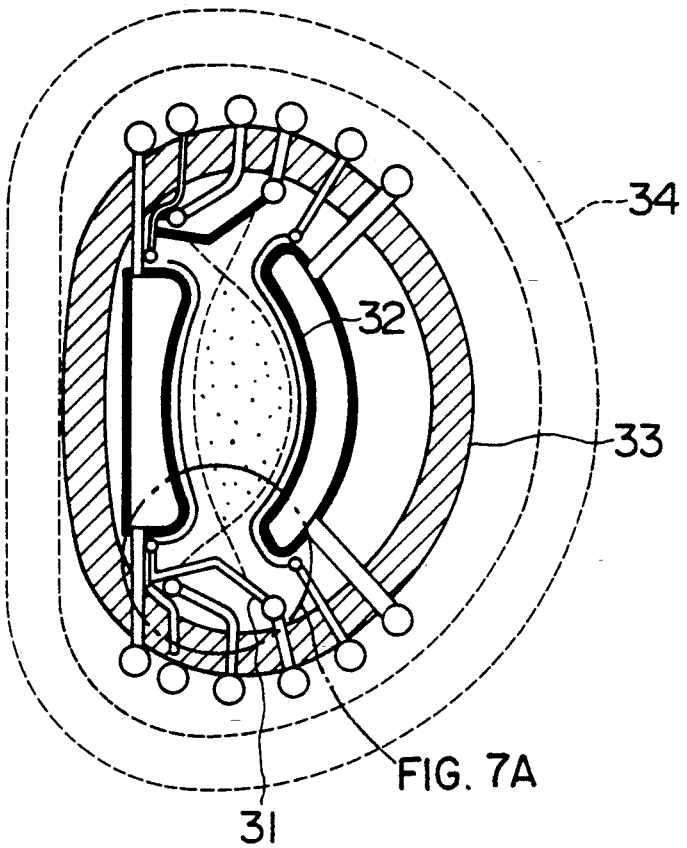

FIG. 7 is a schematic cross sectional view which illustrates a TOKAMAK type nuclear fusion reactor and FIG. 7A is an enlarged view of a portion of FIG. 7 showing ceramic tiles 35. Referring to the drawing, reference numeral 31 represents a divertor, 32 a first wall and a cooling panel and 33 a vacuum vessel. Those members and devices constitute a core of a TOKAMAK nuclear fusion reactor. They are subjected to irradiation of a large quantity of neutrons and a variety of corpuscular beams allowed to leak from plasma and are brought into contact with cooling water, which is heated to high temperature by heat exchange, for the purpose of realizing the apparatus. When the above-described members and devices are made of the Fe-Cr-Mn alloy according to the present invention, lowering of the concentration of chromium at grain boundaries due to irradiation can be prevented. Therefore, corrosion resistance of those members can be improved.

The above-described invertor 31, the first wall 32 and the vacuum vessel 33 are made of the alloy according to the present invention and have a structure arranged to be cooled with water. The divertor 31 and the first wall 32 comprise mechanically or metallurgically joined blocks or tiles 35 each of which is composed of elements of low atomic number (for example, SiC, $Si_3N_4$, AlN, $Al_2O_3$ and ceramics) on a surface of the metal member of the water cooling structure. The alloy according to the present invention may be also applied to those members and devices each of which is constituted by plates and pipes.

Although omitted from illustration, a nuclear fusion reactor comprises a toroidal coil, a poloidal coil and a vacuum exhaust unit. An open magnetic field type reactor and an inertia containment laser heating type reactor are also known as nuclear fusion reactors. The alloy according to the present invention can also be applied to the above-described reactors, causing satisfactory reliability.

As will be apparent from the above, lowering of concentration of chromium at grain boundaries due to irradiation of high-energy particles such as neutrons can be prevented by adding aluminum to an Fe-Cr-Mn alloy according to the present invention. Therefore, when the Fe-Cr-Mn alloy to which aluminum has been added is employed to manufacture members and devices for a core of a light-water nuclear reactor, a fast breeder, a nuclear fusion reactor or the like, deterioration in corrosion resistance and the strength of the alloy at grain boundaries can be prevented or the above-described characteristics can be improved. When the alloy according to the present invention is employed as material for constituting the core portion of a light-water nuclear reactor, irradiation assisted stress corrosion cracking (SCC) can be satisfactorily prevented.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An Fe-Cr-Mn alloy having a completely ferrite structure and which consists essentially of, by weight:

manganese . . . 5 to 40%, chromium . . . 7 to 18%, aluminum . . . 2.0 to 12%; and the balance consisting essentially of iron and unavoidable impurities.

2. An Fe-Cr-Mn alloy consisting essentially of the following elements in the following composition by wt% and having a completely ferrite structure;

manganese . . . 5 to 40%;

chromium . . . 7 to 18%;

aluminum . . . 2.0 to 12%;

one or more elements selected from a group consisting of 0.01 to 5.0% of silicon and 0.01 to 1.0% of titanium; and the balance consisting essentially of iron and unavoidable impurities.

3. An Fe-Cr-Mn alloy consisting essentially of the following elements in the following composition by wt% and having a completely ferrite structure:

manganese . . . 5 to 40%;

chromium . . . 7 to 18%;

aluminum . . . 2.0 to 12%;

one or more elements selected from a group consisting of 0.01 to 5.0% of silicon and 0.01 to 1.0% of titanium;

one or more elements selected from a group consisting of 0.002 to 0.5% of carbon and 0.001 to 0.3% of nitrogen; and the balance consisting essentially of iron and unavoidable impurities.

4. An Fe-Cr-Mn alloy consisting essentially of the following elements in the following composition by wt% and having a mixture of ferrite and austenite structures, the ferrite structure occupying at least 10% by area of the alloy;

5 to 40% of manganese, 2 to 15% of nickel, 0.01 to 0.08% of phosphor and one or more elements selected from a group consisting of 0.002 to 0.5% of carbon and 0.001 to 0.5% of nitrogen, which meet a nickel equivalent equation of $0.5\ Mn+Ni+30\ C+26\ N) \geqq 9\%$;

chromium . . . 7 to 18%;

aluminum . . . 2 to 12%;

silicon . . . 0.01 to 5.0%;

molybdenum . . . 4% or less; and the balance consisting essentially of iron and unavoidable impurities.

5. An Fe-Cr-Mn alloy consisting essentially of the following elements in the following composition by wt% and having a mixture of ferrite and austenite structures, the ferrite structure occupying at least 10% by area of the alloy;

5 to 40% of manganese, 2 to 15% of nickel, 0.01 to 0.08% of phosphor and one or more elements selected from a group consisting of 0.002 to 0.5% of carbon and 0.001 to 0.5% of nitrogen which meet a nickel equivalent equation of $(0.5\ Mn+Ni+30\ C+26\ N) \geqq 9\%$;

chromium . . . 7 to 18%;

aluminum . . . 2 to 12%;

silicon . . . 0.01 to 5.0%;

molybdenum . .. 4% or less;

one or more elements selected from a group consisting of titanium, zirconium, hafnium, niobium and tantalum which makes the titanium equivalent equation of $0.1\% \leqq (Ti+0.53\ Zr+0.27\ Hf+0.52\ Nb+0.26\ Ta) \leqq 0.4\%$; and the balance consisting essentially of iron and unavoidable impurities.

6. A nuclear reactor comprising the following components thereof: a core supporting plate, a neutron instrumentation pipe, a control rod insertion pipe, a shroud, an upper lattice plate, a fuel assembly cladding pipe and a channel box, one or more said components being made of an alloy consisting essentially of the following elements by wt%:

5 to 40% of manganese, 2 to 15% of nickel, and one or more elements selected from a group consisting of 0.002 to 0.5% of carbon and 0.001 to 0.3% of nitrogen which meet a nickel equivalent of $(0.5\ Mn+Ni+30\ C+26\ N) \geqq 9\%$;

chromium . . . 7 to 18%;

aluminum . . . 2 to 12%;

silicon . . . 0.01 to 5.0%;

molybdenum . .. 4% or less; and the balance consisting essentially of iron and unavoidable impurities, said alloy having a mixture of ferrite and austenite structures, the ferrite structure occupying at least 10% by area of the alloy.

7. A nuclear reactor comprising the following components in a pressure vessel thereof: a core supporting plate, a neutron instrumentation pipe, a control rod insertion pipe, a shroud, an upper lattice plate, a fuel assembly cladding pipe and a channel box, one or more said components being made of an alloy consisting essentially of the following elements by wt%:

5 to 40% manganese, 2 to 15% of nickel, and one or more elements selected from a group consisting of 0.002 to 0.5% of carbon and 0.001 to 0.3% of nitrogen which meet a nickel equivalent of $(0.5\ Mn+Ni+30\ C+26\ N) \geqq 9\%$;

chromium . . . 7 to 18%;

aluminum . . . 2 to 12%;

silicon . . . 0.01 to 5.0%;

molybdenum . .. 4% or less; and the balance consisting essentially of iron and unavoidable impurities, said alloy having a mixture of ferrite and austenite structures, the ferrite structure occupying at least 10% by area of the alloy.

8. A nuclear fusion reactor comprising the following components of a vacuum vessel of a water cooling structure thereof: a divertor arranged in such a manner that ceramic tiles are provided on its side adjacent to plasma; and a first wall arranged in such a manner that ceramic tiles are provided on its side adjacent to plasma, one or more said components being made of an alloy consisting essentially of the following elements by wt%:

5 to 40% manganese, 2 to 15% of nickel, and one or more elements selected from a group consisting of 0.002 to 0.5% of carbon and 0.001 to 0.3% of nitrogen which meet a nickel equivalent of $(0.5\ Mn+Ni+30\ C+26\ N) \geqq 9\%$ chromium . . . 7 to 18%;

aluminum . . . 2 to 12%;

silicon . . . 0.01 to 5.0%;

molybdenum . .. 4% or less; and the balance consisting essentially of iron and unavoidable impurities, said alloy having a mixture of ferrite and austenite structures, the ferrite structure occupying at least 10% by area of the alloy.

9. A nuclear fusion reactor comprising the following components of a vacuum vessel of a water cooling structure: a divertor provided with ceramic tiles; and a first wall provided with ceramic tiles, one or more said components being made of an alloy consisting essentially of the following elements by wt%:

5 to 40% of manganese, 2 to 15% nickel, and one or more elements selected from a group consisting of 0.002 to 0.5% of carbon and 0.001 to 0.3% of nitrogen which meet a nickel equivalent of $(0.5\ Mn+Ni+30\ C+26\ N) \geqq 9\%$ chromium . . . 7 to 18%;

aluminum . . . 2.0 to 12%;

silicon . . . 0.01 to 5.0%;

molybdenum . . . 4% or less; and the balance consisting essentially of iron and unavoidable impurities, said alloy having a mixture of ferrite and austenite structures, the ferrite structure occupying at least 10% by area of the alloy.

10. An Fe-Cr-Mn alloy consisting essentially of the following elements in the following composition by wt% and wherein the alloy has a completely ferrite structure:

manganese . . . 5 to 40%;

chromium . . . 5 to 18%;

aluminum . . . 2.0 to 12%;

one or more elements selected from a group consisting of 0.01 to 5.0% of silicon and 0.01 to 1.0% of titanium;

one or more elements selected from a group consisting of 0.002 to 5.0% of carbon and 0.001 to 0.3% of nitrogen;

one or more elements selected from a group consisting of 0.01 to 0.4% zirconium, 0.003 to 0.1% boron and 0.01 and 0.08% of phosphor; and the balance consisting essentially of iron and unavoidable impurities.

11. An Fe-Cr-Mn alloy according to claim 1, wherein the alloy comprises aluminum in an amount of 3–6% by weight.

12. An Fe-Cr-Mn alloy according to claim 1, wherein the alloy comprises chromium in an amount of 12–18% by weight.

13. A nuclear reactor according to any one of claim 6 and 11, wherein said alloy comprises aluminum in an amount of 3–6% by weight.

14. A nuclear reactor according to any one of claims 6 and 7, wherein said alloy comprises chromium in an amount of 12–18% by weight.

15. A nuclear fusion reactor according to any one of claims 8 and 9, wherein said alloy comprises aluminum in an amount of 3–6% by weight.

16. A nuclear fusion reactor according to any one of claims 8 and 9, wherein said alloy comprises chromium in an amount of 12–18% by weight.

* * * * *